US008126177B2

(12) United States Patent
Jensen

(10) Patent No.: US 8,126,177 B2
(45) Date of Patent: Feb. 28, 2012

(54) MODULAR CHARGER FOR HEARING AID

(75) Inventor: Lars Tuborg Jensen, Copenhagen (DK)

(73) Assignee: Zounds Hearing, Inc., Phoenix, AZ (US)

( * ) Notice: Subject to any disclaimer, the term of this patent is extended or adjusted under 35 U.S.C. 154(b) by 1291 days.

(21) Appl. No.: 11/805,187

(22) Filed: May 22, 2007

(65) Prior Publication Data

US 2008/0292123 A1 Nov. 27, 2008

(51) Int. Cl.
*H04R 25/00* (2006.01)

(52) U.S. Cl. ..... 381/323; 381/322

(58) Field of Classification Search ..... 381/312, 381/322, 323, 327, 328; 320/96–98, 100, 320/108, 114, 115; 429/163, 164, 175, 176, 429/94

See application file for complete search history.

(56) References Cited

U.S. PATENT DOCUMENTS

| | | | | |
|---|---|---|---|---|
| 5,253,300 | A * | 10/1993 | Knapp | 381/323 |
| 5,484,668 | A * | 1/1996 | Kutz et al. | 429/121 |
| 6,310,960 | B1 * | 10/2001 | Saaski et al. | 381/323 |
| 2005/0041827 | A1 * | 2/2005 | Wu | 381/323 |
| 2007/0104343 | A1 * | 5/2007 | Bengtsson et al. | 381/323 |

* cited by examiner

*Primary Examiner* — Tuan Nguyen
(74) *Attorney, Agent, or Firm* — Paul F. Wille

(57) ABSTRACT

A battery charger for a hearing aid includes a housing that defines at least one socket for receiving any one of a plurality of adapters. Each adapter closely fits and at least partially contains one hearing aid to hold the hearing aid in place during charging. The hearing aid includes a plurality of electrical contacts in a pattern and the adapter defines a plurality of apertures in the same pattern. Resilient contacts in the charger extend through the apertures in the adapter to contact the hearing aid.

8 Claims, 1 Drawing Sheet

MODULAR CHARGER FOR HEARING AID

BACKGROUND

This invention relates to a hearing aid having at least one rechargeable battery, and in particular, to a recharging system that is easily configured to receive hearing aids of distinct shapes and sizes.

Hearing aids having rechargeable batteries have been known in the art for a long time; e.g., see U.S. Pat. No. 3,297,933 (McCarthy). The trade-off between rechargeable batteries and non-rechargeable batteries is the inconvenience of having to replace a battery. There is also a trade-off in capacity. A non-rechargeable battery lasts much longer than a rechargeable battery having the same outside dimensions as the non-rechargeable battery. This is due to the different chemistries of the two types of batteries.

The inconvenience of having to remove the battery from a hearing aid initially applied both to rechargeable batteries and non-rechargeable batteries. The sole advantage of rechargeable batteries was not having to be replaced. Then, chargers were developed that made electrical contact with a hearing aid, obviating the need to remove the rechargeable battery; e.g. see U.S. Pat. No. 3,493,695 (Stork). This simplified matters for those lacking the dexterity to remove and insert a battery.

A problem remains with the diversity of hearing aids on the market. The most obvious difference is between in-the-ear hearing aids and behind-the-ear hearing aids. Even within a given type, there are variations in shape and size that must be accommodated. Preferably, each hearing aid is held optimally so the user can readily insert and remove the hearing aid from the charger. The cost of manufacturing and storing the various unique chargers can add considerably to the cost of a hearing aid system, even if the charger can charge two hearing aids simultaneously.

Simply making a chamber large enough to drop in a hearing aid of almost any shape does not assure proper contact for charging. A hearing aid must be positioned correctly to assure electrical contact. Within a charger, the contact leaves or pins must be properly aligned for contact and be able to withstand repeated use.

In view of the foregoing, it is therefore an object of the invention to provide a battery charger that can be adapted to hearing aids of distinctly different shapes and sizes.

Another object of the invention is to provide a battery charger for a hearing aid that reliably connects electrically to the hearing aid.

A further object of the invention is to reduce the cost of manufacturing battery chargers for hearing aids.

SUMMARY OF THE INVENTION

The foregoing objects are achieved by this invention in which a battery charger for a hearing aid includes a housing that defines at least one socket for receiving any one of a plurality of adapters. Each adapter closely fits and at least partially contains one hearing aid to hold the hearing aid in place during charging. The hearing aid includes a plurality of electrical contacts in a pattern and the adapter defines a plurality of apertures in the same pattern. Resilient contacts in the charger extend through the apertures in the adapter to contact the hearing aid.

BRIEF DESCRIPTION OF THE DRAWINGS

A more complete understanding of the invention can be obtained by considering the following detailed description in conjunction with the accompanying drawings, in which:

The FIGURE is an exploded view of a preferred embodiment of the invention.

DETAILED DESCRIPTION OF THE INVENTION

Figure 1:
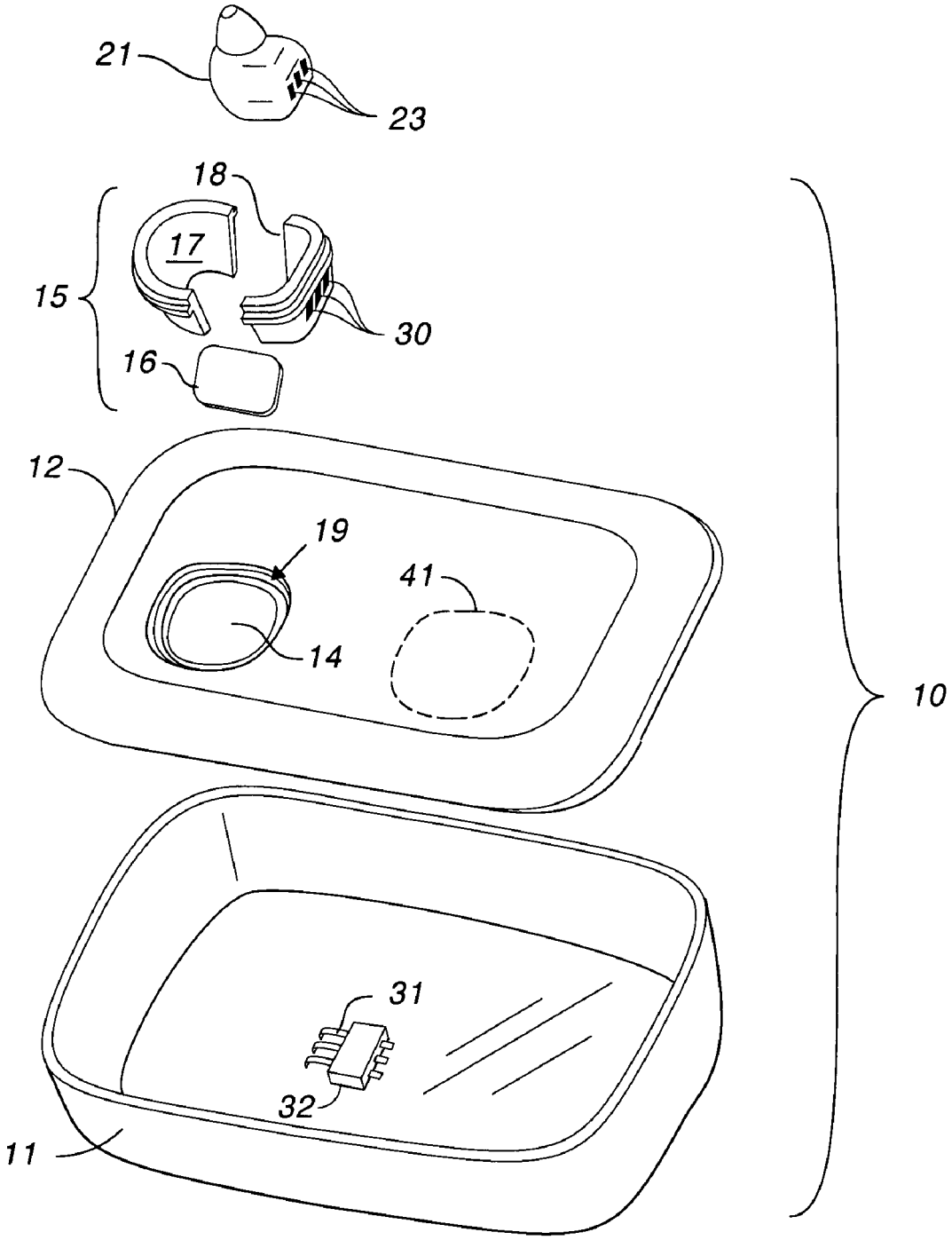

In the FIGURE, charger 10 includes base 11 and cover 12 of suitable shape and volume for containing the electronics (not shown) that actually charges one or more batteries in one or more hearing aids. Cover 12 includes socket 14. Although illustrated as somewhat rectangular, socket 14 can have any desired shape. In accordance with the invention, a custom adapter fits within socket 14 to hold a hearing aid having a particular shape in place for charging.

In a preferred embodiment of the invention, adapter 15 includes floor 16 and shells 17 and 18. Although an adapter could be made in a single piece, the shells can have intricate shapes and yet be easily released from a mold. Floor 16 can be molded as part of either shell. Adapter 15 fits within socket 14 and adapts charger 10 to a particular hearing aid or model of hearing aid. Adapter 15 can be made from any suitable material. A resilient plastic is preferred.

Adapter 15 preferably includes a lip for engaging cover 12 and preventing adapter 15 from passing through cover 12. A dado or shoulder is preferably formed in rim 19 of socket 14 for receiving a lip, thereby providing a smooth upper surface on cover 12 when adapter 15 is in place.

The outer surface of adapter 15 is shaped to pass through socket 14. The inner surface of adapter 15 is shaped to receive a particular hearing aid, such as hearing aid 21. Hearing aid 21 can be held by frictional engagement, by interference fit (such as a bead and groove), or by other means to keep hearing aid 21 in the proper position for charging.

As illustrated in the figure, hearing aid 21 includes three rectangular apertures 23 through which electrical contact is made to the hearing aid. Adapter 15 defines apertures 30 that align with the apertures in hearing aid 21. When adapter 15 is inserted into socket 14 and cover 12 is attached to base 11, resilient contacts 31 within base 11 extend through the aligned apertures to provide contact between the electronics in base 11 and hearing aid 21. Contacts 31 are preferably molded into plastic carrier 32 for precise, durable alignment.

The invention thus provides a battery charger that can be adapted to hearing aids of distinctly different shapes and sizes and that reliably connects electrically to the hearing aid. The cost of manufacturing battery chargers for hearing aids is reduced because the housing and the electronics can remain the same, only the adapter changes. That is, a single housing can accept a plurality of adapters but each adapter is designed to closely fit a single hearing aid or single type of hearing aid. Resilient contacts molded into a plastic carrier reduce dimensional tolerances and simplify production. The adapter can have a complex internal structure, e.g. undercuts, without significantly increasing the overall cost of the charger. Developing a new hearing aid does not require developing a new charger. One simply changes adapters. This simplifies development and testing of new designs.

Having thus described the invention, it will be apparent to those of skill in the art that various modifications can be made within the scope of the invention. For example, socket 14 could engage adapter 15 along the sides or bottom of the adapter, in addition to or instead of at rim 19. Although the electrical connections described relate to charging, the electrical connections can be used for other purposes, such as programming a hearing aid from the charger. As indicated by dashed line 41, charger 10 can optionally include adapters for more than one hearing aid. Base 11 and cover 12 form a container divided along an essentially horizontal plane. The container for the electronics of the charger can have any configuration, e.g. divided along a vertical plane or a clamshell type of case. What matters is that the container include at least one socket for receiving adapter 15. Each adapter could have its own set of resilient contacts in the apertures but it is preferred, and less expensive, that contacts 31 extend through empty apertures in the adapter to contact a hearing aid. One could use pogo pins for resilient contacts but a leaf spring type of contact is preferred because such a contact provides a self-cleaning, wiping action when a hearing aid is inserted into the charger. Base 11 is illustrated as solid. Holes for ventilation or electrical access are not shown as they do not relate to the invention.

What is claimed as the invention is:

1. A battery charger for hearing aids, said charger including electronics in a housing, characterized in that the housing defines at least one socket for receiving one of a plurality of adapters; and said one adapter closely fits at least one hearing aid;

whereby a hearing aid is held in place by the adapter during charging.

2. The battery charger as set forth in claim 1 wherein the hearing aid includes a plurality of electrical contacts in a pattern and said one adapter defines a plurality of apertures in the same pattern as the electrical contacts of the hearing aid.

3. The battery charger as set forth in claim 2 further characterized in that the charger includes resilient contacts that extend through the apertures in the adapter to provide electrical contact to a hearing aid.

4. The battery charger as set forth in claim 3 wherein the resilient contacts are molded into a plastic carrier.

5. The battery charger as set forth in claim 3 wherein said resilient contacts are leaf spring types of contacts.

6. The battery charger as set forth in claim 1 wherein said adapter resiliently holds a hearing aid.

7. The battery charger as set forth in claim 1 wherein said adapter frictionally engages a hearing aid.

8. The battery charger as set forth in claim 1 wherein said adapter is molded in more than one piece.

* * * * *